US005271501A

United States Patent [19]

Chen

[11] Patent Number: 5,271,501

[45] Date of Patent: Dec. 21, 1993

[54] TOOLBOX

[75] Inventor: Chang Chen, Taichung Hsien, Taiwan

[73] Assignee: Tung I Enterprise Co., Ltd., Taichung Hsien, Taiwan

[21] Appl. No.: 16,849

[22] Filed: Feb. 12, 1993

[51] Int. Cl.[5] ..... B65D 6/00; B25H 3/02

[52] U.S. Cl. ..... 206/373

[58] Field of Search ..... 206/372-380

[56] References Cited

U.S. PATENT DOCUMENTS

| | | | |
|---|---|---|---|
| 4,951,812 | 8/1990 | Chen | 206/373 X |
| 4,998,616 | 3/1991 | Hillinger | 206/372 X |
| 5,145,064 | 9/1992 | Chen | 206/372 |

FOREIGN PATENT DOCUMENTS

| | | | |
|---|---|---|---|
| 1017447 | 9/1952 | France | 206/373 |
| 2244259 | 11/1991 | United Kingdom | 206/372 |

*Primary Examiner*—William I. Price

*Attorney, Agent, or Firm*—Baker & Daniels

[57] ABSTRACT

A toolbox has a main casing part which confines first and second tool receiving compartments therein, and a first casing cover hinged to the main casing part and turnable between a folded position, wherein the first casing cover covers the first tool receiving compartment, and an open position, wherein the first tool receiving compartment is uncovered. The first casing cover confines a third tool receiving compartment therein. A second casing cover is hinged to the main casing part and is turnable between a folded position, wherein the second casing cover covers the second tool receiving compartment, and an open position, wherein the second tool receiving compartment is uncovered. The second casing cover confines a fourth tool receiving compartment therein. An inner tray is hinged to the second casing cover and is turnable between a folded position, wherein the inner tray covers the fourth tool receiving compartment, and an open position, wherein the fourth tool receiving compartment is uncovered. The inner tray extends into the second and fourth tool receiving compartments when the inner tray and the second casing cover are in the respective folded positions. The inner tray confines a fifth tool receiving compartment therein.

6 Claims, 3 Drawing Sheets

TOOLBOX

BACKGROUND OF THE INVENTION

1. Field of the Invention The invention relates to a toolbox, more particularly to a toolbox which can receive, in an orderly manner, a greater number of tools without substantially increasing its size.

2. Description of the Related Art

Toolboxes usually comprise a pair of casing halves having tool receiving spaces to receive various kinds of tools. A main drawback of conventional toolboxes is that the sizes thereof would have to be increased greatly in order to accommodate a larger number of tools.

SUMMARY OF THE INVENTION

Therefore, the objective of the present invention is to provide a toolbox which can receive a greater number of tools without substantially increasing its size.

Accordingly, the toolbox of the present invention comprises:

a main casing part which confines first and second tool receiving compartments therein;

a first casing cover hinged to the main casing part and turnable between a folded position, wherein the first casing cover covers the first tool receiving compartment, and an open position, wherein the first tool receiving compartment is uncovered, said first casing cover confining a third tool receiving compartment therein;

a second casing cover hinged to the main casing part and turnable between a folded position, wherein the second casing cover covers the second tool receiving compartment, and an open position, wherein the second tool receiving compartment is uncovered, said second casing cover confining a fourth tool receiving compartment therein; and an inner tray hinged to the second casing cover and turnable between a folded position, wherein the inner tray covers the fourth tool receiving compartment, and an open position, wherein the fourth tool receiving compartment is uncovered, said inner tray extending into the second and fourth tool receiving compartments when the inner tray and the second casing cover are in the respective folded positions, said inner tray confining a fifth tool receiving compartment therein.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Referring to Figures and 2, the preferred embodiment of a toolbox according to the present invention is preferably made of molded plastic parts and is shown to comprise a main casing part (10), a first casing cover (20), a second casing cover (30) and an inner tray (40).

Figure 3:
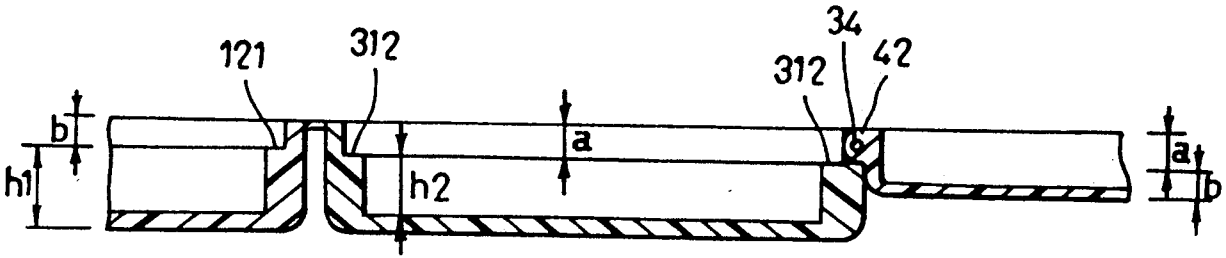
FIG. 3 is a III—III section of FIG. 2.

The main casing part (10) is substantially rectangular in shape and has a pair of opposite first peripheral sides (100, 102) and a pair of opposite second peripheral sides (104, 106) which interconnect the first peripheral sides (100, 102) and which cooperate with the first peripheral sides (100, 102) so as to confine a receiving space that is divided by a partition (13) which extends across the first peripheral sides (100, 102) into two differently-sized first and second tool receiving compartments (11, 12). The main casing part (10) is formed with a plurality of tool receiving spaces (111) in the first tool receiving compartment (11). Each of the tool receiving spaces (111) has an outermost edge that is provided with a resilient inward flange to prevent the untimely removal of tools in the tool receiving spaces (111). The second tool receiving compartment (12) is formed with a peripheral shoulder (121) which has a predetermined depth (h1), as shown in FIG. 3. The outermost edge of the peripheral shoulder (121) forms a clearance (b) with the outermost edge of the main casing part (10). A cross-shaped partition (122) is formed integrally with the peripheral shoulder (121) and divides the second tool receiving compartment (12) into four smaller compartments for receiving irregularly-shaped tools therein. A handle (14) is provided on an intermediate portion of the first peripheral side (102) by forming an elongated opening therein. Alternatively, a handle projection may be formed integrally on the intermediate portion of the first peripheral side (102) to serve as the handle of the toolbox. The first peripheral side (102) is further provided with a fastening unit (15, 16) on two sides of the handle (14). Each of the fastening units (15, 16) includes a pair of elongated fastening projections (151, 161).

Figure 1:
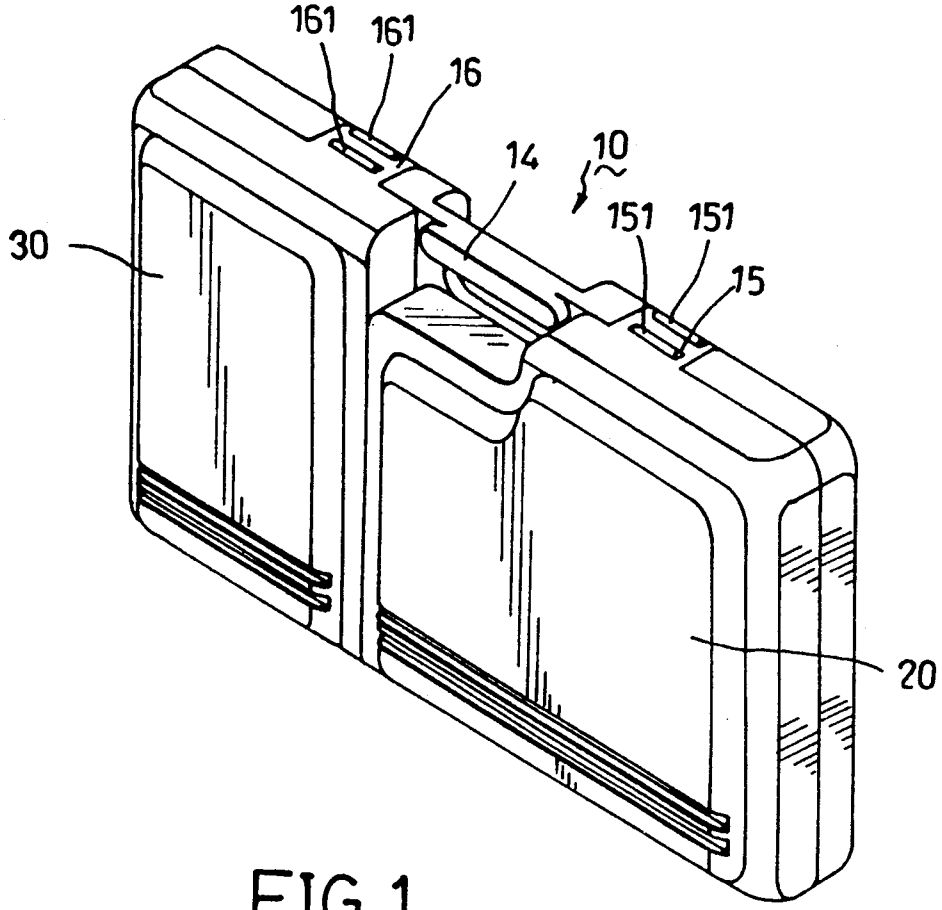
FIG. 1 is a perspective view of the preferred embodiment of a toolbox according to the present invention when in a fully folded position.
Figure 2:
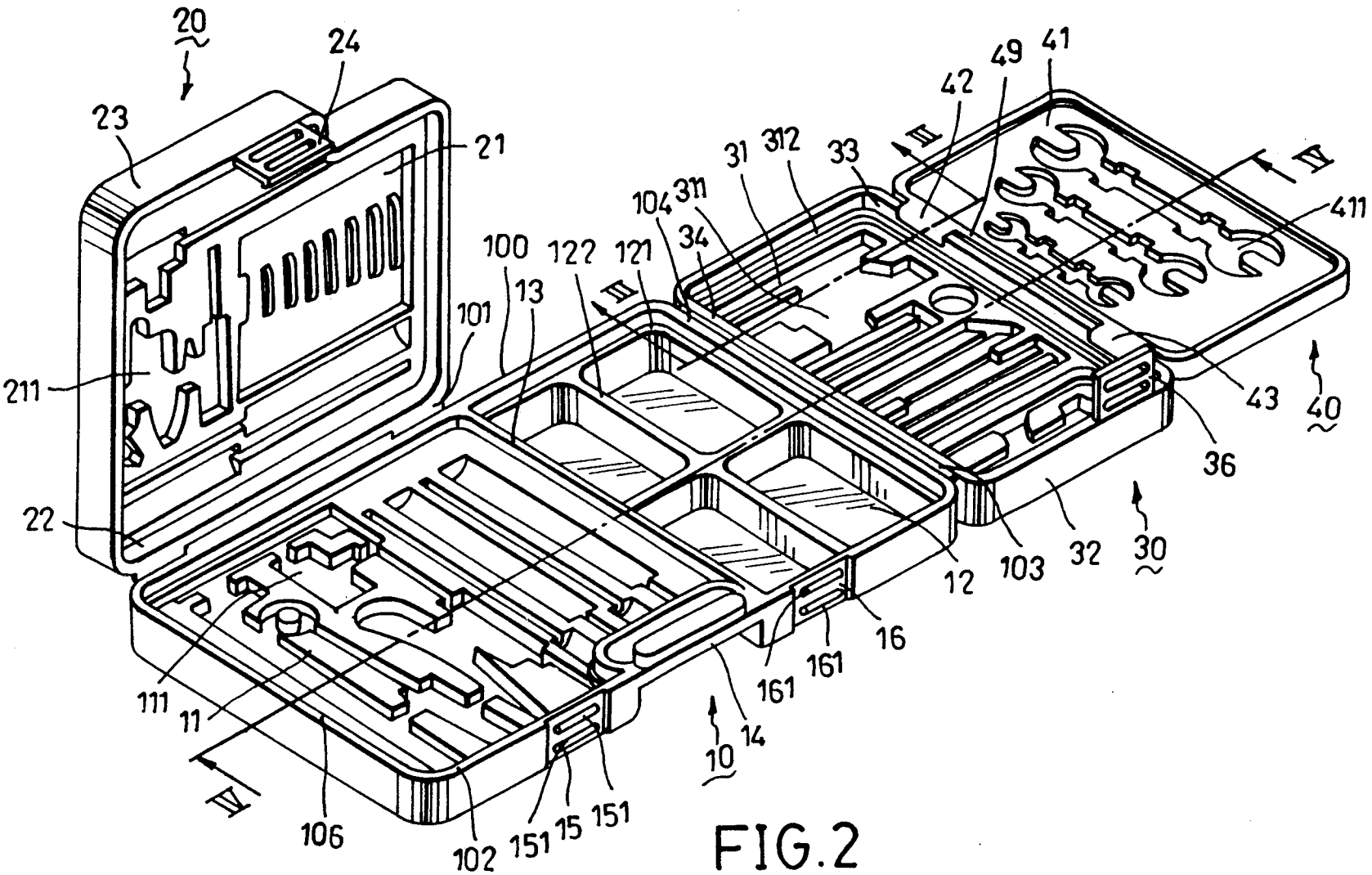
FIG. 2 is a perspective view of the preferred embodiment when in a fully opened position.

The first casing cover (20) is similarly rectangular in shape and confines a third tool receiving compartment (21) which is equal in size to the first tool receiving compartment (11). A plurality of tool receiving spaces (211) is formed in the third tool receiving compartment (21). The first casing cover (20) has a first peripheral side (22) which is hinged to the first peripheral side (100) of the main casing part (10) via a flexible hinge strip (101). The first casing cover (20) is thus turnable relative to the main casing part (10) between an open position, as shown in FIG. 2, and a folded position, in which the first casing cover (20) covers the first tool receiving compartment (11), as shown in FIG. 1. The first casing cover (20) has a second peripheral side (23) that is opposite to the first peripheral side (22) and that is provided with a fastening member (24) which cooperates with the fastening unit (15) so as to form a first fastening device. The fastening member (24) engages releasably the fastening unit (15) on the first peripheral side (102) of the main casing part (10) so as to retain releasably the first casing cover (20) in the folded position.

The second casing cover (30) is also rectangular in shape and has a depth that is equal to that of the first casing cover (20). The second casing cover (30) confines a fourth tool receiving compartment (31) which is equal in size to the second tool receiving compartment (12) of the main casing part (10). A plurality of tool receiving spaces (311) is formed in the fourth tool receiving compartment (31). The second casing cover (30) has a first peripheral side (34) which is hinged to the second peripheral side (104) of the main casing part (10) via a flexible hinge strip (103). The second casing cover (30) is thus turnable relative to the main casing part (10) between an open position, as shown in FIG. 2, and a folded position, in which the second casing cover (30) covers the second tool receiving compartment (12), as shown in FIG. 1. Referring once more to FIG. 3, the fourth tool receiving compartment (31) is formed with a peripheral shoulder (312) which has a predetermined depth (h2). The outermost edge of the peripheral shoulder (312) forms a clearance (a) with the outermost edge of the second casing cover (30). Therefore, when the second casing cover (30) is in the folded position, the peripheral shoulders (121, 312) cooperatively define a total clearance (a+b) therebetween. The second casing part (30) has a second peripheral side (32) that is adjacent to the first peripheral side (34) and that is provided with a fastening member (36) which cooperates with the fastening unit (16) on the first peripheral side (102) of the main casing part (10) so as to form a second fastening device. The fastening member (36) engages releasably the fastening unit (16) so as to retain releasably the second casing cover (30) in the folded position.

Figure 4:
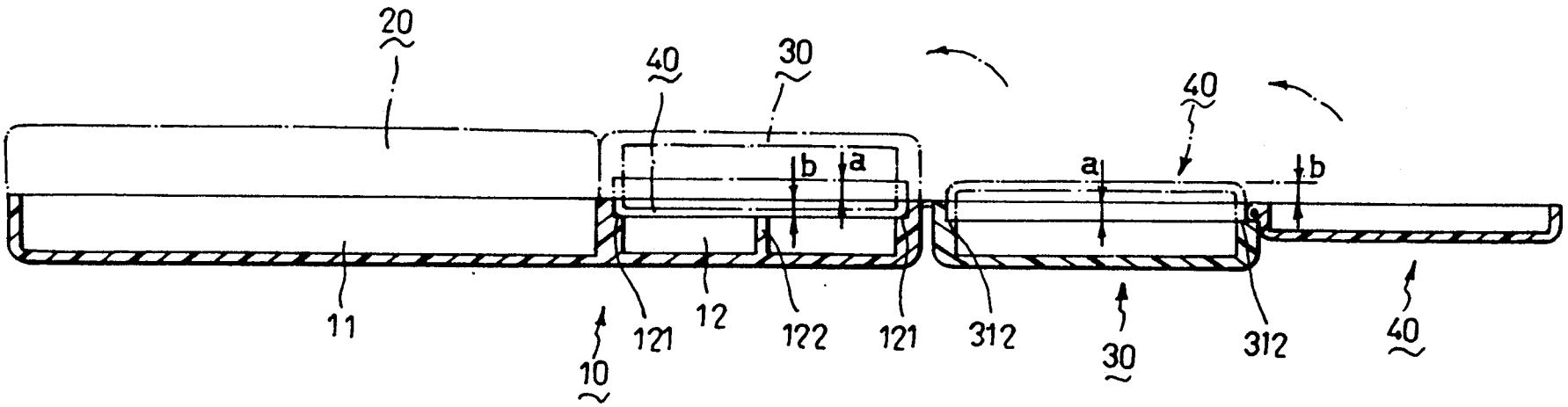
FIG. 4 is a IV—IV section of FIG. 2.

The inner tray (40) is also rectangular in shape and has a first peripheral side (49) which is hinged to a third peripheral side (33) of the second cover casing (30) via a pair of hinge projections (42, 43) and a hinge pin (34). The inner tray (40) is thus turnable relative to the second casing cover (30) between an open position, as shown in FIG. 2, and a folded position, in which the inner tray (40) covers the fourth tool receiving compartment (31), as shown in FIG. 4. The depth of the inner tray (40) is equal to the depth of the total clearance (a+b). The inner tray (40) confines a fifth tool receiving compartment (41) therein. A plurality of tool receiving spaces (411) is formed in the fifth tool receiving compartment (41). Note that since the size of the fifth tool receiving compartment (41) is smaller than those of the tool receiving compartments (11, 12, 21, 31), the tool receiving spaces (411) are adapted to receive only flat tools, such as wrenches and the like, therein.

Referring to FIG. 4, when folding the preferred embodiment from the fully opened position to the fully folded position, the inner tray (40) is first turned toward the second casing cover (30) such that the outermost edge of the inner tray (40) extends into the fourth tool receiving compartment (31) and rests on the peripheral shoulder (312) of the second casing cover (30). The second casing cover (30) is then turned toward the main casing part (10) such that the bottom of the inner tray (40) extends into the second tool receiving compartment (12) and rests on the peripheral shoulder (121) and on the cross-shaped partition (122) in the second tool receiving compartment (12) of the main casing part (10). The outermost edge of the second casing cover (30) abuts the outermost edge of the second tool receiving compartment (12) so as to cover the latter, and the inner tray (40) is disposed in the total clearance (a+b) formed between the peripheral shoulders (312, 121) of the second casing cover (30) and the main casing part (10). The fastening member (36) of the second casing cover (30) engages the fastening unit (16) of the main casing part (10) so as to retain the second casing cover (30) in the folded position. The first casing cover (20) is turned toward the main casing part (10) such that the outermost edge of the former abuts the outermost edge of the first tool receiving compartment (11) so as to cover the latter. Finally, the fastening member (24) of the first casing cover (20) engages the fastening unit (15) of the main casing part (10) so as to retain the first casing cover (20) in the folded position.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A toolbox, comprising:

a main casing part which confines first and second tool receiving compartments therein;

a first casing cover hinged to said main casing part and turnable between a folded position, wherein said first casing cover covers said first tool receiving compartment, and an open position, wherein said first tool receiving compartment is uncovered, said first casing cover confining a third tool receiving compartment therein;

a second casing cover hinged to said main casing part and turnable between a folded position, wherein said second casing cover covers said second tool receiving compartment, and an open position, wherein said second tool receiving compartment is uncovered, said second casing cover confining a fourth tool receiving compartment therein; and an inner tray hinged to said second casing cover and turnable between a folded position, wherein said inner tray covers said fourth tool receiving compartment, and an open position, wherein said fourth tool receiving compartment is uncovered, said inner tray extending into said second and fourth tool receiving compartments when said inner tray and said second casing cover are in the respective said folded positions, said inner tray confining a fifth tool receiving compartment therein.

2. The toolbox as claimed in claim 1, further comprising:

a first fastening device provided on said main casing part and said first casing cover for retaining releasably said first casing cover in the folded position; and a second fastening device provided on said main casing part and said second casing cover for retaining releasably said second casing cover in the folded position.

3. The toolbox as claimed in claim 1, further comprising a handle formed integrally on said main casing part.

4. The toolbox as claimed in claim 1, wherein at least of said first, second, third, fourth and fifth tool receiving compartments is formed with at least one tool receiving space.

5. The toolbox as claimed in claim further comprising a flexible hinge strip interconnecting said main casing part and said first casing cover.

6. The toolbox as claimed in claim further comprising a flexible hinge strip interconnecting said main casing part and said second casing cover.

* * * * *